US006591770B1

(12) United States Patent
Blackmore

(10) Patent No.: US 6,591,770 B1
(45) Date of Patent: Jul. 15, 2003

(54) BOATING LIFT

(75) Inventor: William R. Blackmore, Bloomington, MN (US)

(73) Assignee: St. Croix Marine Products, Inc., Bloomington, MN (US)

( * ) Notice: Subject to any disclaimer, the term of this patent is extended or adjusted under 35 U.S.C. 154(b) by 0 days.

(21) Appl. No.: 09/706,136

(22) Filed: Oct. 23, 2000

(51) Int. Cl.[7] ..... B63C 1/02

(52) U.S. Cl. ..... 114/48; 114/44; 114/259; 114/365; 405/3; 414/137.7

(58) Field of Search ..... 114/44–48, 258–260, 114/365, 366, 368, 369, 370, 374, 377, 380; 405/3; 414/137.7, 137.8, 678, 630, 631; 187/226, 250, 251, 272–274

(56) References Cited

U.S. PATENT DOCUMENTS

| | | | | | |
|---|---|---|---|---|---|
| 2,761,571 | A | * | 9/1956 | Adams | 414/137.7 |
| 3,203,568 | A | * | 8/1965 | Quayle | 414/621 |
| 3,841,442 | A | * | 10/1974 | Erickson et al. | 187/226 |
| 3,997,029 | A | * | 12/1976 | Evans | 187/227 |
| 4,020,777 | A | * | 5/1977 | Brown et al. | 114/258 |
| 4,155,538 | A | * | 5/1979 | Claassen | 254/277 |
| 4,641,596 | A | * | 2/1987 | Reprogle et al. | 114/44 |
| 4,773,346 | A | * | 9/1988 | Blanding et al. | 114/45 |
| 4,797,055 | A | * | 1/1989 | Tworoger et al. | 414/283 |
| 4,900,187 | A | * | 2/1990 | Uchida et al. | 405/3 |
| 5,082,090 | A | * | 1/1992 | Walker | 187/230 |
| 5,090,841 | A | * | 2/1992 | Penick, Jr. et al. | 405/3 |
| 5,140,923 | A | * | 8/1992 | Wood | 114/48 |
| 5,326,217 | A | * | 7/1994 | Simpson et al. | 414/635 |
| 5,522,671 | A | * | 6/1996 | Keesling | 405/3 |
| 5,544,606 | A | * | 8/1996 | Schmidt, Jr. | 114/48 |
| 6,003,463 | A | * | 12/1999 | Giesler | 114/259 |
| 6,178,914 | B1 | * | 1/2001 | Axelsson | 114/368 |

FOREIGN PATENT DOCUMENTS

| | | | | |
|---|---|---|---|---|
| DE | 3535122 | * | 4/1987 | 114/258 |
| JP | 4-269209 | * | 9/1992 | 114/259 |

* cited by examiner

*Primary Examiner*—S. Joseph Morano
*Assistant Examiner*—Ajay Vasudeva
(74) *Attorney, Agent, or Firm*—Dennis A. Gross; The Hill Firm

(57) ABSTRACT

A boat lift for attachment to the aft transom of a larger boat for lifting and lowering smaller water craft, utilizes a single double acting hydraulic cylinder to move a truck horizontally within an enclosure. Cables fixed to the truck cause movement of vertically disposed connectors attached to a intermediate vertically moveable members which in turn include cables attached to vertically moveable support posts which carry water craft support arms.

8 Claims, 4 Drawing Sheets

BOATING LIFT

BACKGROUND OF THE INVENTION

1. Field of the Invention

The present invention relates to hoists and in to particular to water craft hoists of the type generally affixed to the aft end of boats.

2. Description of the Related Art

It has become increasingly common for large private water craft, or yachts, to transport auxiliary water craft such as dinghies, jet skies, PWCs and the like. While it has been generally known to mount such auxiliary craft to an upper deck or roof structure and to utilize cranes for loading and unloading, many boat designs are ill adapted for such use. Recently it has become more common to provide a replacement swim platform or platform extension at the aft end of the vessel and to equipment the platform with chocks to cradle the auxiliary craft. Loading and unloading heavy auxiliary craft to and from an out of water platform still requires the use of a crane or other hoist.

More recently, powered platforms, or boat lifts, capable of raising and lowering with respect to the host boat have been proposed. Such devices have included telescoping vertical structures carrying horizontal supports or arms to which a platform or boat chock set can be affixed. It has been known to power the telescoping structures both by individual hydraulic cylinders, such as shown in U.S. Pat. No. 5,544,606 or by means of motor driven cables such as shown, for example, in U.S. Pat. No. 4,878,450.

While such devices may work satisfactorily for consistently weighted auxiliary craft, they may experience difficulties with properly lifting, lowering and supporting water craft which are heavier at one end than the other. Since it is common to utilize aft of center engine and propulsion placement in auxiliary craft, generally the aft section is heavier than the bow section. Such unequal weighting provides unequal loading on horizontally spaced vertically moveable supports.

It would be an advance in the art to provide a self-leveling device where unequal weight distribution of the auxiliary craft would not cause tilting, cocking or binding of the lifting system. It would be a further advance in the art to utilize hydraulic power while eliminating the need for multiple hydraulic cylinders in an auxiliary water craft lifting device.

It would be a further advance in the art to utilize a single double acting hydraulic cylinder which is enclosed and maintained out of the water and which drives a cable system for raising and lowering an auxiliary water craft support structure.

SUMMARY OF THE INVENTION

This invention provides a hydraulically powered, cable connected, vertically extensible and retractable auxiliary water craft lift which is attachable to the aft end of a host vehicle and which raises and lowers an auxiliary water craft support structure with respect to the host boat so that the support structure may be lowered into the water allowing the auxiliary water craft to float free of its support and can thereafter be raised above the water to lift the auxiliary water craft above the water surface.

In a preferred embodiment of my invention, I provide a first U-shaped base structure which is to be stationary mounted to the hoist boat, preferably at the aft end, and usually to the stern transom. This U-shape structure is substantially out of the water and includes an upper horizontal member which contains a double acting hydraulic cylinder and a horizontally moveable truck. Vertically positioned legs at either end of the horizontal member include cable directing sheaves for routing lifting and lowering cables attached to the horizontally moveable truck. The vertical legs also receive movable connectors which in turn are connected to vertically movable intermediate members which, based upon the direction of movement of the truck are raised or lowered with respect to the vertical legs by the cables. The intermediate moveable members in turn extendably and retractably carry support posts. Cables connected to the support posts and to the vertical legs are trained around sheaves in the intermediate members causing the support posts to extend and retract vertically with respect to the intermediate members as a result of movement of the intermediate members with respect to the vertical legs.

The support posts in turn carry platform supporting arms to which either a platform or water craft support cradle is attached. By utilizing cables driven by the hydraulic cylinder movement of the support arms is coordinated irrespective of the weight distribution between the support arms.

It is therefore an object of this invention to provide an improved boat lift structure for mounting to hoist boats.

It is another, and more specific object of this invention to provide hydraulically driven, cable actuated, auxiliary water craft raising and lowering device utilizing a single hydraulic cylinder to operate spaced extending and retracting water craft support arms.

It is an object of this invention to provide an auxiliary water craft hoist system to be affixed to the aft of larger water craft, the system employing a U-shaped structure with a horizontal member carrying a single double acting hydraulic cylinder with depending vertical members providing a cable assembly affixed to the hydraulic cylinder and to vertically extendable and retractable members which are in turn operatively connected to an auxiliary water craft support structure.

It is an object of this invention to provide a cable driven, hydraulically powered, auxiliary water craft support hoist for attachment to host vessels employing a single double acting hydraulic cylinder which moves a truck member having a cable connected to it which in turn raises and lowers vertically disposed intermediate members which in turn utilize cabling to vertically move support posts carried by the intermediate members.

These and other objects of the present invention will be understood from the following description of the preferred embodiment by way of an example.

DETAILED DESCRIPTION OF THE PREFERRED EMBODIMENTS

Figure 1:
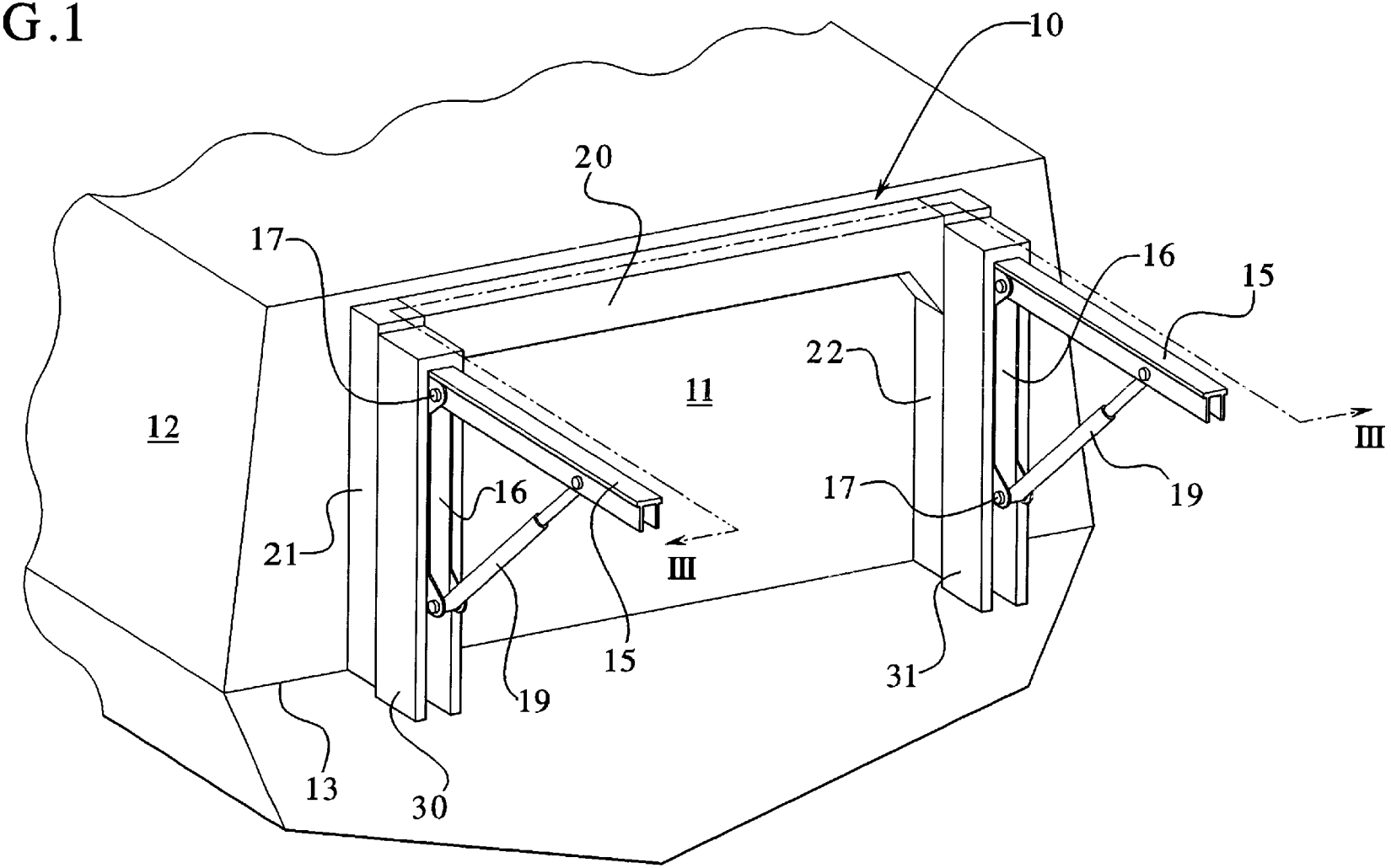
FIG. 1 is illustrates a boat lift according to this invention mounted to the stern transom of a boat.

The boat lift 10 of this invention is show in FIG. 1 carried on the stern transom 11 at the aft of a boat 12 substantially generally above the water line 13. The boat lift includes generally horizontally extending support arms 15 which extend aft of the boat 12. As illustrated, the arms 15 may be attached to support posts 16 through pin and bracket connections 17 allowing the support arms to be removed if desired such as for convenient off season storage of the boat 12. Adjustable telescoping supports 19 may be used to properly angularly position the support arms 15 so as to provide substantially horizontal positioning of the support arms as desired 15 irrespective of the angle of transom 11 or the riding angle of the boat 12.

In addition to the support posts 16, the boat lift includes a horizontal top member 20 having depending vertical legs 21 and 22 adjacent each end of the horizontal member 20. The members 20, 21 and 22 are fixed to the transom 11 such as by pin and bracket connectors and do not move with respect to it. Intermediate members 30 and 31 are carried by the legs 21 and 22 and are moveable vertically with respect to the legs. The support posts 16 are carried by the intermediate members 30 and 31 and are moveable vertically with respect to them.

Figure 2:
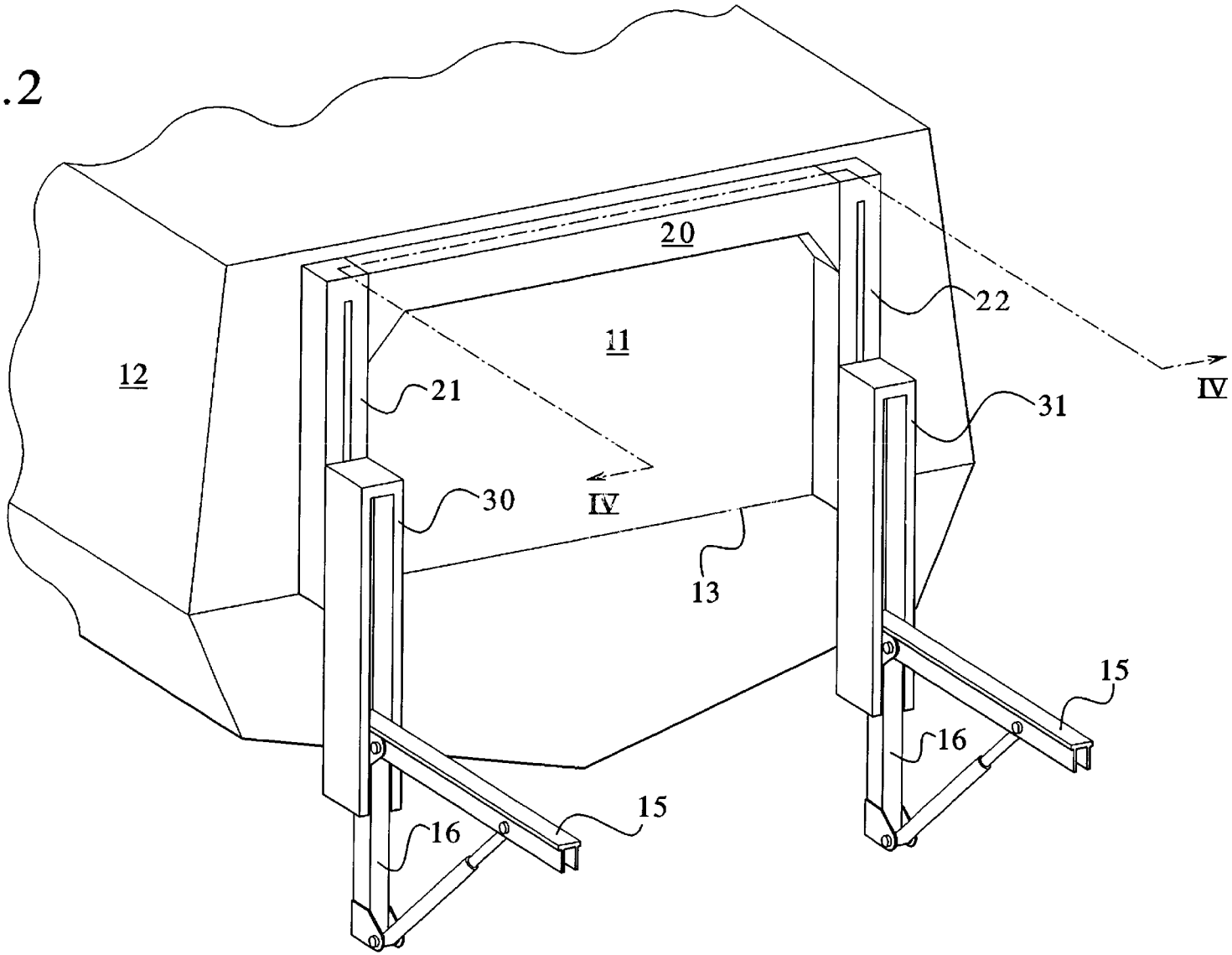
FIG. 2 shows the boat lift of FIG. 1 in its extended or down position.

Thus, as shown in FIG. 2, the support arms 15 may be lowered to a position substantially below the water line 13 or, as shown in FIG. 1, raised to a position substantially above the water line. As will be understood, the support arms 15 can be provided in any desired configuration and may be used, for example, to support an extended swim platform, a water craft cradle or a simple water craft retaining chocks.

Although I have chosen to illustrate the horizontal member 20, the legs 21 and 22, the intermediate members 31 and 32 and the support posts 16 as being generally rectangular in cross section, it will be appreciated that other shapes may similarly be used.

Figure 3:
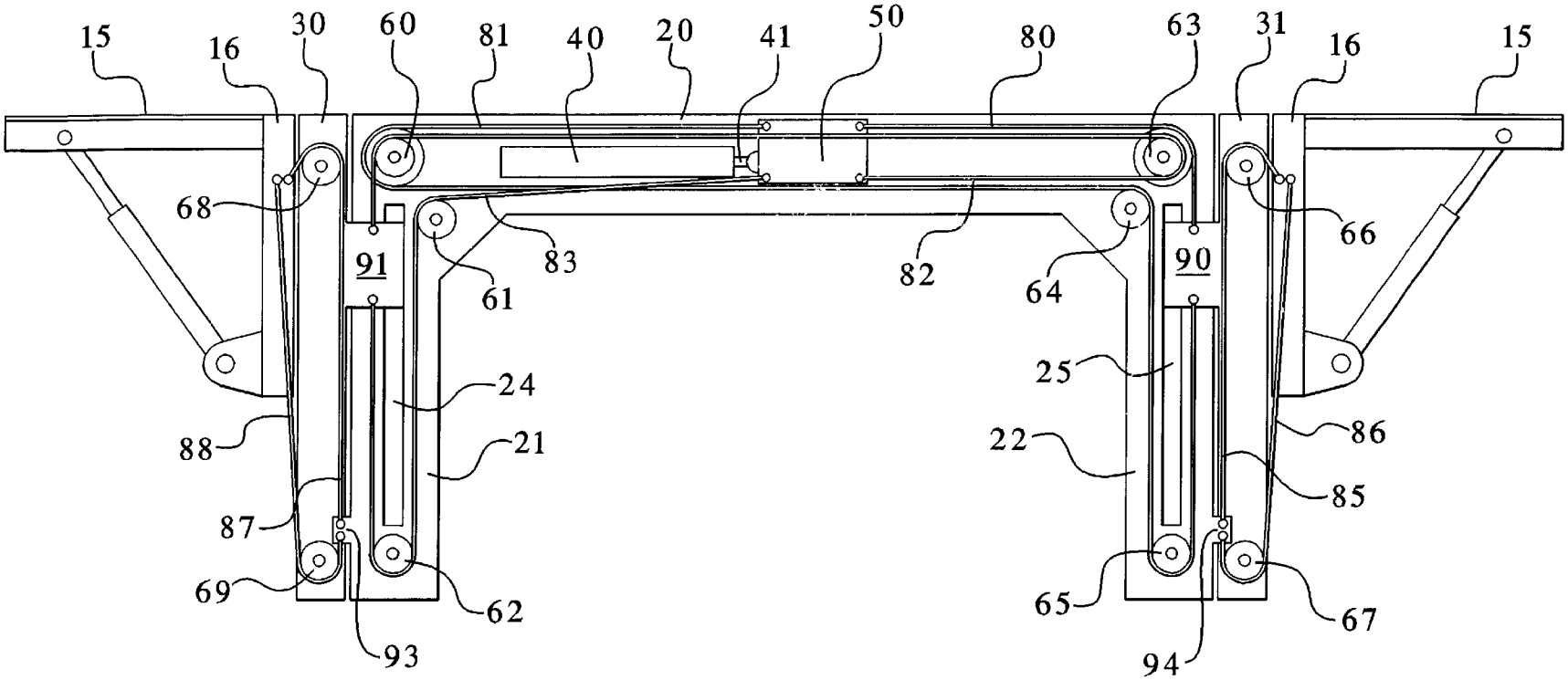
FIG. 3 is a schematic sectional view of the boat lift showing the internal cabling and connectors with the support arms in the elevated position taken substantially along the lines ii–iii of FIG. 1.

FIG. 3 illustrates the internal mechanisms of my boat lift, it will be appreciated that the intermediate members 30 and 31, support posts 16 and support arms 13 are illustrated rotated respectively to the left and right and that in actual operation would be positioned in front of the vertical legs 21 and 22.

Positioned within the horizontal member 20 is a fixed hydraulic cylinder 40 having a moveable power arm 41. The cylinder is preferably a double acting hydraulic cylinder and will be powered from on-board hydraulic pressure systems utilizing appropriate control technology, which may, for example, include standard pressure limiters, pressure release valves, load sensors and appropriate hosing and coupling all of which will be readily familiar to those familiar with hydraulic systems.

Arm 41 in turn is connected to a truck 50 which moves horizontally within the horizontal member 20. The truck may be provided with appropriate barring supports, guide ways and the like to stabilize its movement within the horizontal member. The ends of four cables are attached to the truck and are routed around the sheaves 61 through 65 which are in turn rotatably carried by the horizontal member 20 and the vertical legs 21 and 22. It will be appreciated that although I have shown only one set of sheaves and cables, that a second set, for example attached to the back side of the truck, can also be employed. For ultra high load systems, more than two sets of cables may be employed.

In the illustration of FIG. 1, a first cable 80 is shown attached to the top right hand side of the truck 50. This cable passes over sheave 63 and attaches adjacent the top of a connector 90 which is moveably positioned within leg 22 and which is fixedly attached to intermediate member 31. A companion cable 81, shown attached to the upper left side of truck 50, is entrained about sheave 60, sheave 64 and sheave 65 and is attached adjacent the bottom of connector 90. Similarly, cable 82 extends from the right side of truck 50 around sheave 63, then around sheave 60 and is affixed adjacent the top of connector 91 carried moveably interior of leg 21. Cable 83, attached to the lower left side of truck 50 is entrained above sheave 61 and sheave 62 and is attached adjacent the bottom of connector 91.

Figure 4:
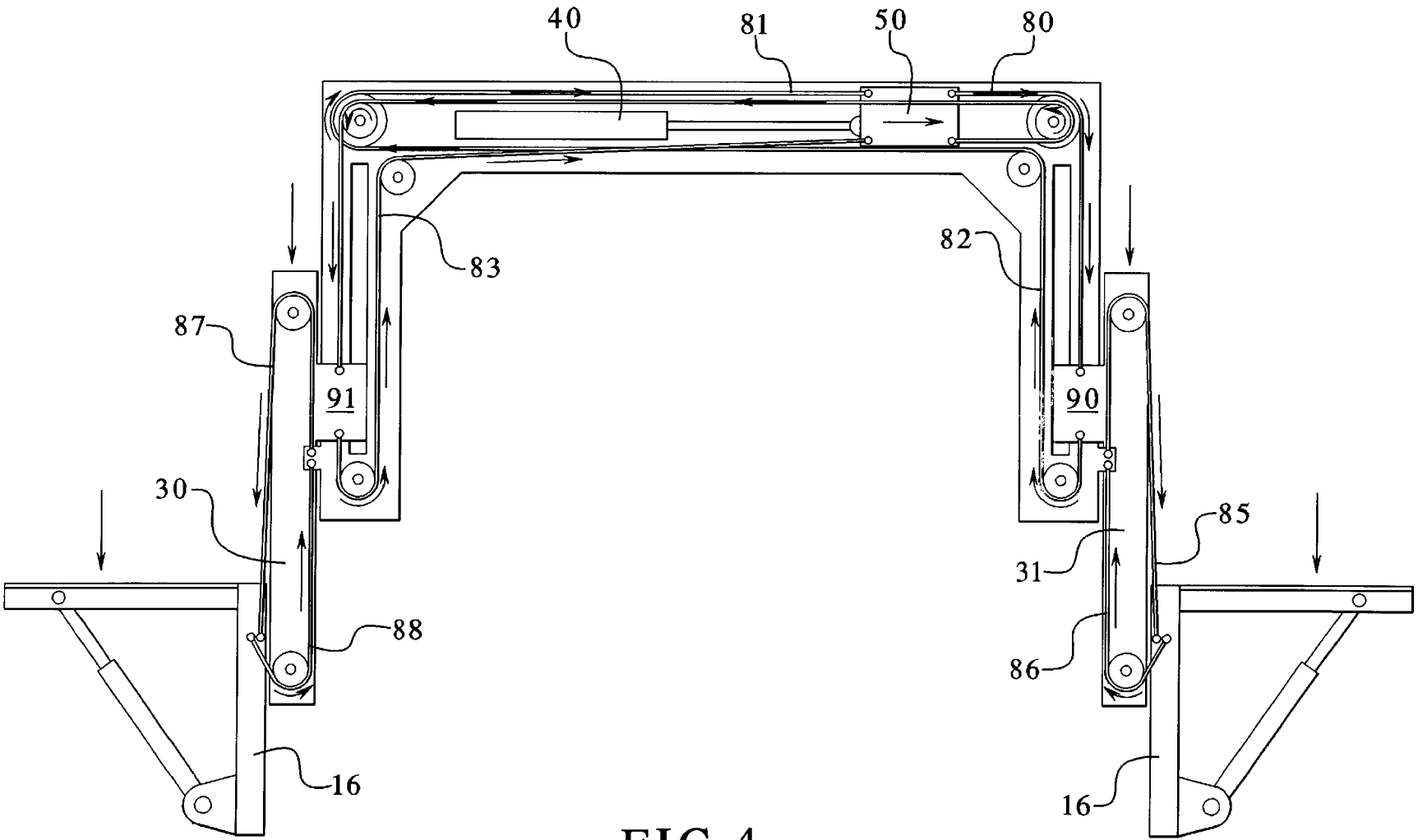
FIG. 4 is a similar schematic view to FIG. 3 showing the support arms in the lowered position.

It will be appreciated that in the schematic illustrated, sheaves 60 and 63 are double. It will therefore be seen that movement of the power arm 41 will cause movement of the truck 50 which in turn will cause vertical movement of the connectors 90 and 91. This in turn will cause vertical movement of the intermediate members 30 and 31 fixedly attached respectively to connectors 90 and 91. The arrows in FIG. 4 illustrate cable movement occurring during downward movement of the intermediate members by movement of the truck to the right. It will be appreciated that upon movement of the truck to the left, the movement of the cables will be opposite the arrows thereby causing the intermediate members to lift.

As illustrated in FIG. 3, connectors 90 and 91 project through slots 24 and 25 in respectively, legs 21 and 22 and are fixedly attached to the intermediate members 30 and 31. It will be appreciated that the intermediate members 30 and 31 will be securely carried by the legs and in manner which stabilizes and guides the intermediate members while allowing vertical motion. If desired this can be accomplished through the connectors 90 and 91 which may be securely channeled interior of the legs 21 and 22.

The intermediate members carry sheaves 66, 67, 68 and 69 about which are entrained cables 85, 86, 87, and 88. The legs 21 and 22 are provided with fixed cable attachment brackets 93 and 94 to which one end respectively of the cable sets 85, 86, 87 and 88 are attached. The other end of the cable sets are attached to the support posts 16. As illustrated, cables, 85 and 87 are entrained around respectively sheaves 66 and 68 and cables 86 and 88 are entrained around sheaves 67 and 69. In this manner, upon movement of the intermediate members 30 and 31, the support posts 16 are caused to move vertically with respect to the intermediate members. Since the support posts 16 are carried by the intermediate members, they also move with the intermediate members thus multiplying the movement of the support posts 16. Again, FIG. 4 shows by arrows the movements of the cables affixed to the support posts during the lowering operation.

It will be understood that support posts 16 are securely carried by the intermediate members and are guided for movement with respect thereto. For example, the support post 16 may be telescopically received interior of the intermediate members 31 basically as illustrated in FIGS. 1 and 2. By use of cables in both directions of movement of the power arm, this invention provides powered movement of the support posts in both up and down directions.

Although I have chosen to illustrate my invention with reference to a single preferred embodiment, it will be readily appreciated by those skilled in the art that many variations and modifications can be used. For example, although I have shown a single double acting cylinder 40 attached to one side of the truck 50, substantially the same level lifting can be accomplished utilizing opposed hydraulic cylinders, either single acting or double acting, attached to opposite ends of the truck. Moreover, although I have illustrated the invention as being used with cable, it will be appreciated that other types such as chain, strap or cord may be used, all of which I intend to be included within the generic term cable. Furthermore, although I have illustrated the support arms 15 as being attached adjacent the top of the support posts, in other embodiments they may be attached at other points along the support posts. Other and further modifications will be apparent to those skilled in the art.

I claim as my invention:

1. An auxiliary lifting device for attachment to a boat comprising first and second generally horizontally projecting support arms generally vertically moveably operatively connected to first and second intermediate members, the intermediate members generally vertically moveably operatively connected to stationary members, a generally horizontally positioned hydraulic cylinder having a power arm and first cabling interconnecting the power arm and the intermediate members and second cabling connecting the intermediate members and the support arms whereby movement of the power arm causes movement of the intermediate members relative to the stationary members which in turn causes movement of the support arms relative to the intermediate members.

2. An auxiliary water craft lift adapted to be fixed to the stem of a host boat comprising at least one horizontally disposed hydraulic cylinder adapted to be carried by the host boat and generally vertically moveable horizontally spaced first and second support posts with cabling operatively connecting the support posts and hydraulic cylinder at least one vertically moveable intermediate member, at least some of said cabling effective to cause movement of the support posts relative to the intermediate member in response to movement of the intermediate member.

3. A lift for attachment to the rear of a boat comprising a first generally horizontal member adapted to be attached to a boat in a generally fixed position, a first hydraulic cylinder carried by the first member having at least one moveable power arm, at least first and second vertically moveable support posts, at least first and second vertically moveable intermediate members respectively operatively connected to the first and second support posts, the support posts vertically moveable with respect to the intermediate members, first cabling interconnecting the power arm and the first and second intermediate members effective to cause generally vertical movement of the first of the first and second intermediate member in a first direction in response to movement of the power arm, second cabling interconnecting the power arm and the first and second intermediate members effective to cause vertical movement of the first and second intermediate members in a second direction substantially opposite the first direction in response to movement of the power arm.

4. A lift for attachment of the rear of a boat comprising a first generally horizontally positioned member adapted to be attached to the boat in a generally fixed position, a first hydraulic cylinder carried by the first member having at least one generally horizontally moveable power arm, at least first and second vertically moveable support posts, at least first and second vertically moveable members operatively positioned between the support posts and the horizontal member, the support posts generally vertically moveable with respect to the vertically moveable members and cabling interconnecting the power arm, vertically moveable members and support posts for causing said support posts to move generally vertically in dependent response to movement of the power arm.

5. The lift of claim 4 wherein the vertically moveable members move with respect to the horizontal member in dependent response to movement of the power arm.

6. An auxiliary lifting device for attachment to a boat comprising: first and second generally horizontally projecting support arms generally vertically moveably operatively connected to first and second intermediate members, the intermediate members generally vertically moveably operatively connected to stationary members, a hydraulic cylinder having a power arm and first cabling interconnecting the power arm and the intermediate members and second cabling connecting the intermediate members and the support arms whereby movement of the power arm causes movement of the intermediate members relative to the stationary members which in turn causes movement of the support arms relative to the intermediate members and wherein each of the cabling acts positively to cause driven movement of the support arms in each of two opposite directions respectively.

7. A boat lift comprising first and second generally vertically moveable support posts operatively carried by, and moveable relative to, generally vertically moveable intermediate members which in turn are operatively carried by vertically fixed members, a generally horizontally disposed power cylinder and cabling interconnecting the power cylinder and intermediate members for causing vertical movement in the intermediate members in dependent response to movement of a portion of the power cylinder.

8. The boat lift of claim 7 including second cabling operatively interconnecting the fixed members and the generally vertically moveable support posts, the second cabling operatively coupled to the intermediate members and effective to move the support posts with respect to the intermediate members in dependent response to movement of the intermediate members with respect to the stationary members.

* * * * *